US005502950A

United States Patent [19]

Moncrief et al.

[11] Patent Number: 5,502,950

[45] Date of Patent: Apr. 2, 1996

[54] PACKAGING MACHINE WITH METERING WHEELS

[75] Inventors: Frank Moncrief, Acworth, Ga.; Charles McNamara, Tucson, Ariz.

[73] Assignee: Riverwood International Corporation, Atlanta, Ga.

[21] Appl. No.: 330,497

[22] Filed: Oct. 28, 1994

[51] Int. Cl.[6] ..... B65B 5/06; B65B 35/44; B65B 35/46; B65B 35/54

[52] U.S. Cl. ..... 53/448; 53/251; 53/543; 53/566

[58] Field of Search ..... 53/443, 447, 566, 53/564, 534, 543, 252, 251, 250, 249, 260, 258, 448, 458

[56] References Cited

U.S. PATENT DOCUMENTS 2,728,177 12/1955 Holstebroe et al. ..... 53/566 X
2,803,932 8/1957 Nigrelli et al. ..... 53/566 X
2,885,841 5/1959 Currie et al. ..... 53/566 X
3,015,923 1/1962 Dotzenroth ..... 53/566 X
4,250,693 2/1981 Andersson ..... 53/566 X

*Primary Examiner*—James F. Coan

[57] ABSTRACT

A packaging machine adapted to meter and load various size groups of articles into receptacles to form a package. Star wheels are used to meter the articles into groups, each star wheel functioning as a single unit in conjunction with an infeed conveyor and a conveyor that feeds the metered groups downstream to a packaging station. Star wheels carrying different numbers of lugs are interchangeable in order to create different size packages on the same machine. The lugs which move the groups of articles and the article receptacles may be relocated as necessary to accommodate different size packages.

7 Claims, 5 Drawing Sheets

28
30
30
32
33
22
14
18
34
24
C
C
C
C
3
3
20
20
16
26
64
39
38
12
66
S
S
S
S
S
36
26
64
12
67
66
12
66

32
30
28
68
14
18
20
16
48
48
C
C
S
S
S
S
S
26
26
64
64
12
12
36
36
66
66
67
67

PACKAGING MACHINE WITH METERING WHEELS

FIELD OF THE INVENTION

This invention relates to a packaging machine of the type that introduces articles into a receptacle, such as a carton sleeve, through the open ends of the receptacle. More particularly, it relates to a packaging machine that utilizes star wheels to segregate a row of incoming articles into groups of the correct size to be packaged.

BACKGROUND OF THE INVENTION

Machines for packaging articles, such as beverage bottles or cans, are adapted to segregate the flow of articles from an infeed conveyor to form groups of a predetermined number of articles. Each group is then moved in a downstream direction at the same speed as a moving row of carton sleeves or other form of receptacle and is subsequently inserted through an adjacent open end of the sleeve at a downstream loading station. Various ways of metering the flow of articles to form groups of the desired size have been employed, including metering screws having a pitch designed to segregate the articles into groups of a certain number and endless chains having spaced lugs which are inserted between predetermined trailing and leading articles of adjacent groups. Such metering means occupy considerable machine space, however, and cannot normally be quickly changed to a different size mechanism to enable the machine to package groups of different sizes.

Another type of metering means makes use of a pair of star wheels wherein one wheel is located so as to hold back the line pressure of the incoming articles and the other wheel accelerates a previously segregated group in its movement downstream. While star wheels of this type are adequate in some respects, they too are difficult and time consuming to replace in order to form different size groups of articles. Further, none of the existing metering systems conveniently allows the number of groups themselves that are to be inserted into a package to be readily changed. The need for such a change would occur, for example, when it is desired to change from simultaneously loading from both sides of a machine, as in loading a carton having a center keel, to loading from only one side into a carton sleeve containing no interior obstructions.

It would be highly desirable to be able to rapidly change the metering system of a packaging machine so as to form groups containing different numbers of articles. It is also necessary to be able to quickly modify the machine to move various size groups of articles to the downstream loading station and to transfer such groups into a moving receptacle.

BRIEF SUMMARY OF THE INVENTION

The article packaging machine of the invention comprises an infeed conveyor for moving articles in a downstream direction, means spaced from the infeed conveyor for moving article receptacles downstream, and article moving means adjacent the receptacle moving means and spaced from the infeed conveyor for moving the articles downstream at the same speed as the receptacle moving means. A driven star wheel is provided between the infeed conveyor and the article moving means. Article guide means are also provided for guiding a continuous row of moving articles from the infeed conveyor to the star wheel and from the star wheel to the article moving means. The star wheel includes a plurality of outwardly extending uniformly spaced metering lugs adapted to separate adjacent articles to form groups of a predetermined number of articles and to move the groups to,the article moving means adjacent a receptacle on the receptacle moving means. The groups of articles are then moved transversely into an adjacent receptacle, preferably by pushing means.

The article moving means preferably includes lugs which define the upstream and downstream boundaries of the groups of articles on the moving means, at least some of which are adapted to be relocated on the article moving means so as to be capable of receiving different size groups of articles. In addition, the star wheel is adapted to be replaced with a different star wheel having a greater or lesser number of lugs so as to enable the packaging machine to be modified to package groups of varying numbers of articles. The transverse pushing means preferably is also capable of pushing article groups containing varying numbers of articles to facilitate a changeover from one package size to another.

To increase the flexibility of the machine a plurality of spaced star wheels can be located between the infeed conveyor and the article moving means. A plurality of guide means for guiding a continuous row of moving articles from the infeed conveyor to each star wheel would also be provided in such an arrangement. Each star wheel separates the moving articles into groups containing the same number of articles, and the groups are moved to the article moving means at locations spaced from each other in the same manner that the star wheels are spaced from each other.

When used to package beverage bottles or cans, wherein each article has a circular transverse cross-section at the point at which the article is engaged by a star wheel lug, the end of each lug extends beyond the centerline of the article and the lug has a configuration such that it first engages an upstream article, slowing movement of the upstream articles until the lug moves into contact with the adjacent downstream article.

By adjusting the location of the lugs on the article moving means and by employing the proper number and type of star wheels to meter articles for the size of package desired to be formed, the same machine can be used to load a large variety of different size packages with minimum downtime and at minimum expense. The features of the invention which enable it to provide these results are brought out in more detail in the detailed description of the preferred embodiment, wherein the above and other aspects of the invention, as well as other benefits, will readily become apparent.

DETAILED DESCRIPTION OF THE PREFERRED EMBODIMENTS

Figure 1:
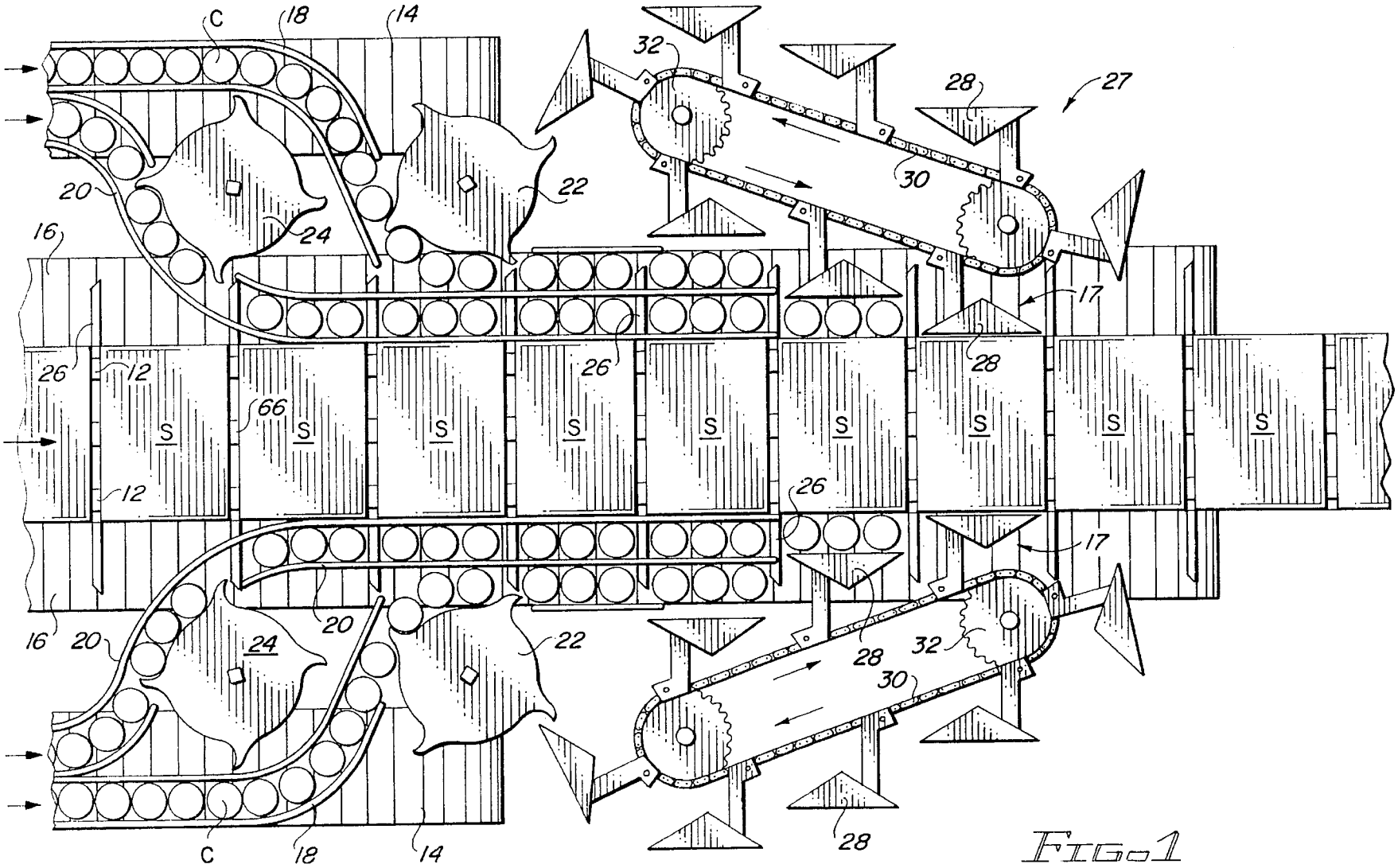
FIG. 1 is a simplified plan view of a packaging machine incorporating the invention.

Referring to FIG. 1, carton sleeves S are pushed downstream along a central path of packaging machine 10 by lugs 12 mounted on endless chains, not shown, located beneath the upper surface of the machine. At the upstream end on either side of the carton sleeve moving means are infeed conveyors 14 which transport beverage containers C or other articles to be packaged in a downstream direction. Between the infeed conveyors 14 and the carton sleeve moving means are accelerator conveyors 16 which receive the containers from the infeed conveyors and move them downstream toward a loading station 17. The containers are shown as being guided to the conveyors 16 by the curved guide rails 18 and 20 and being segregated into groups of three by metering wheels 22 and 24 which are mounted for rotation between the infeed conveyor 14 and the accelerator conveyor 16. By this means, two groups of three containers are fed to the accelerator conveyor 16 between each pair of spaced conveyor lugs 26, with the result that successive groupings of six containers are moved toward the loading station 17. It will be understood by those in the art that a support surface is provided between the infeed conveyor 14 and the conveyor 16 in order to support the containers as they are moved by the star wheels between the two conveyors.

Some of the structure described thus far is typical of packaging machines and may be modified as desired. For example, any desired means for feeding the articles and for moving the carton sleeves other than the means illustrated may be employed. It will be understood, however, that the speed at which the articles C are moved by the conveyor 16 will be the same as the speed at which the carton sleeves S are traveling, and the sleeves and article groupings will be aligned so as to allow the groups of articles to be pushed into the open ends of the sleeves at the loading station. These parameters are well known in the art and the ability to achieve them is well within the scope of one skilled in the art.

Still referring to FIG. 1, a pusher plate mechanism 27 located adjacent the loading station 17 is comprised of a number of pusher plates 28 connected to moving chains 30 trained about sprocket wheels 32. The path of travel of the pusher plates is diagonally toward the moving carton sleeves so that each plate moves both downstream and inwardly toward the sleeves as it approaches the loading station. The downstream component of travel is at the same speed as the speed of the articles C and the sleeves S, and the timing of the movement of the plates in their closed path maintains the plates aligned with an associated moving group of articles and an associated carton sleeve. The inward component of movement of the plates, which is at right angles to the downstream direction, reaches its most inward point at the loading station, resulting in the adjacent group of articles being pushed by the plate through the open end of the adjacent carton sleeve. Although two pusher plate mechanisms are shown in order to load a carton sleeve from both ends, obviously a sleeve can be loaded from just one end if desired by either not running the feed conveyor and pusher plate mechanism on one side of the machine or simply by not supplying such equipment in the first place. As indicated above, however, when packaging a carton which incorporates a center keel, it is necessary to load articles from both sides, in which case feed assemblies and pusher mechanisms would be provided on each side of the machine as shown.

Figure 2:
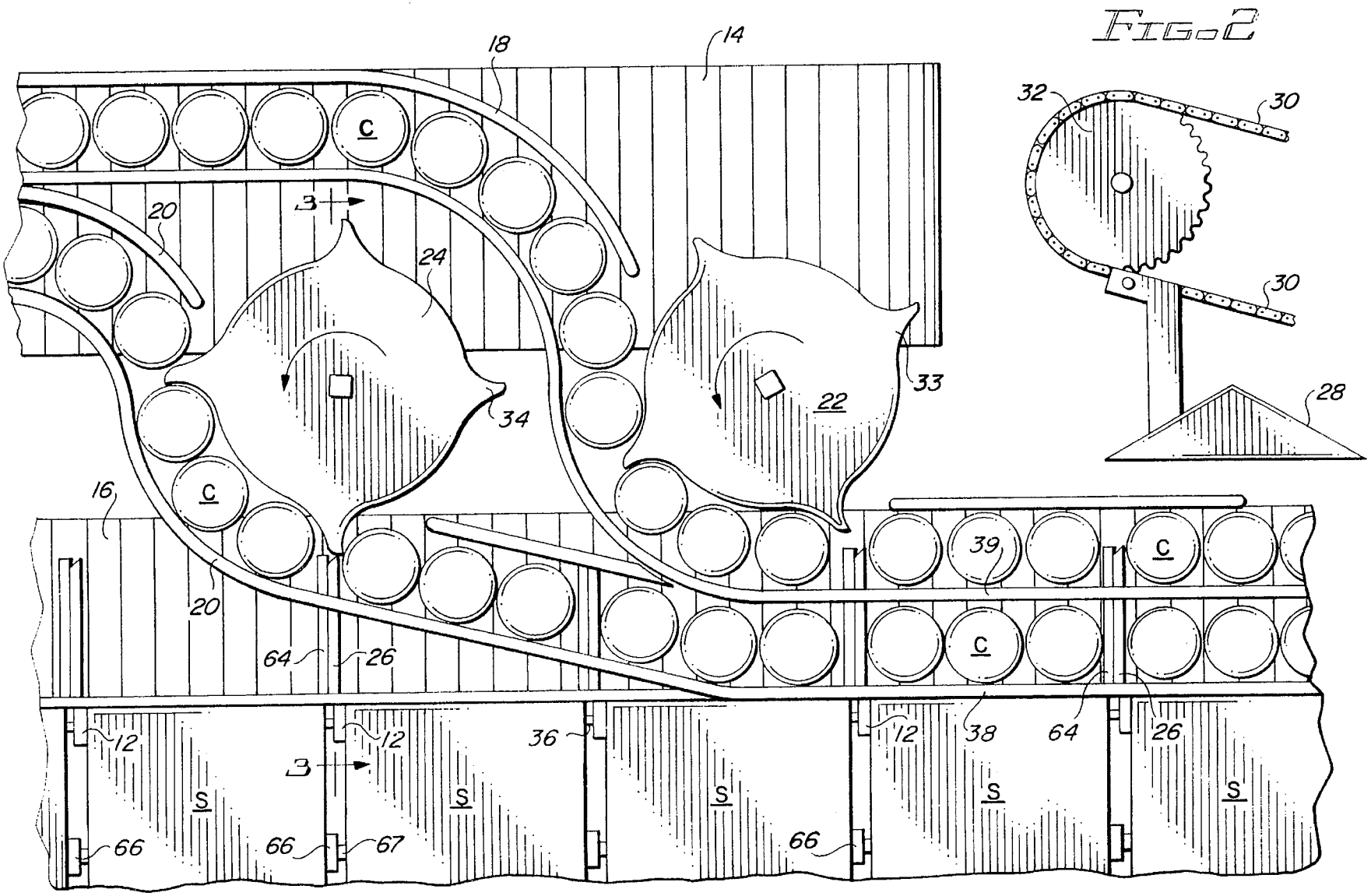
FIG. 2 is an enlarged partial plan view of the machine, showing the metering section and loading station in more detail.

Referring now to FIG. 2, the portion of the machine incorporating the metering section is shown in more detail. The purpose of the metering section is to divide the incoming product stream into groups of the number required for insertion into the package being produced. The metering section in the packaging machine of the invention comprises the infeed conveyor 14, the product guides 18 and 20, the metering star wheels 22 and 24 and the accelerator conveyor 16. The infeed conveyor 14 is driven by a variable speed drive, not shown, and is run at a speed slightly greater than the machine speed. This ensures that the incoming containers C are always available for metering while allowing the line pressure of the incoming articles to be controlled. The guide rails 18 and 20 direct the containers along a path located such that the lugs 33 and 34 of the star wheels 22 and 24 enter the product flow, as explained in more detail below, and the speed of the star wheels is such that the groups of containers are fed onto the accelerator conveyor 16 at the proper interval to allow the lugs 26 of the conveyor 16 to contact the trailing container in the group to push the group of containers downstream. The lugs 26 of the conveyor 16 are aligned with, and move at the same speed as, the lugs 12 of the carton moving chain, resulting in each group of containers moving at the same speed as, and being adjacent to, a carton sleeve S.

Figure 3:
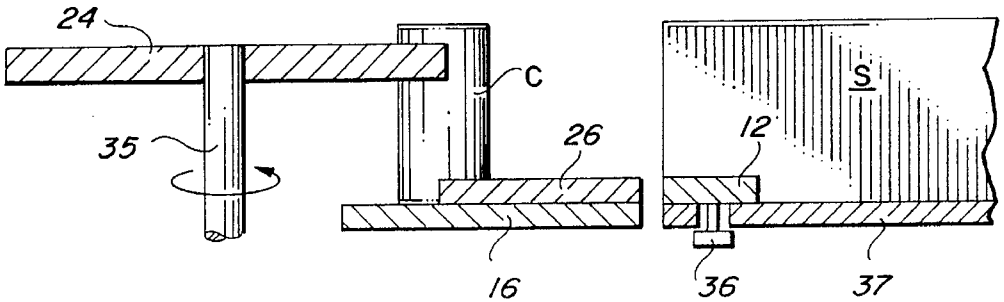
FIG. 3 is an enlarged cross-sectional view taken on line 3—3 of FIG. 2.

The relationship of the various elements described thus far to each other and to the containers C and the carton sleeves S is further brought out in FIG. 3, which shows the containers C being engaged near the bottom by the lugs 26, the guide rails 20 engaging the containers at points intermediate the container height and the star wheel 24 engaging the container between the guide rails and the top of the container. The shaft 35 on which the star wheel is mounted is driven, as previously stated, although the driving means is not shown since the specific means for driving the various movable elements of the machine do not form a part of the novelty of the invention. The pusher lug 26 is also shown to be aligned with the lugs 12 which push the carton sleeves in a downstream direction, and the chain that carries the lugs 12 is indicated at 36. The machine surface over which the carrier sleeves slide is indicated at 37.

Figure 4:
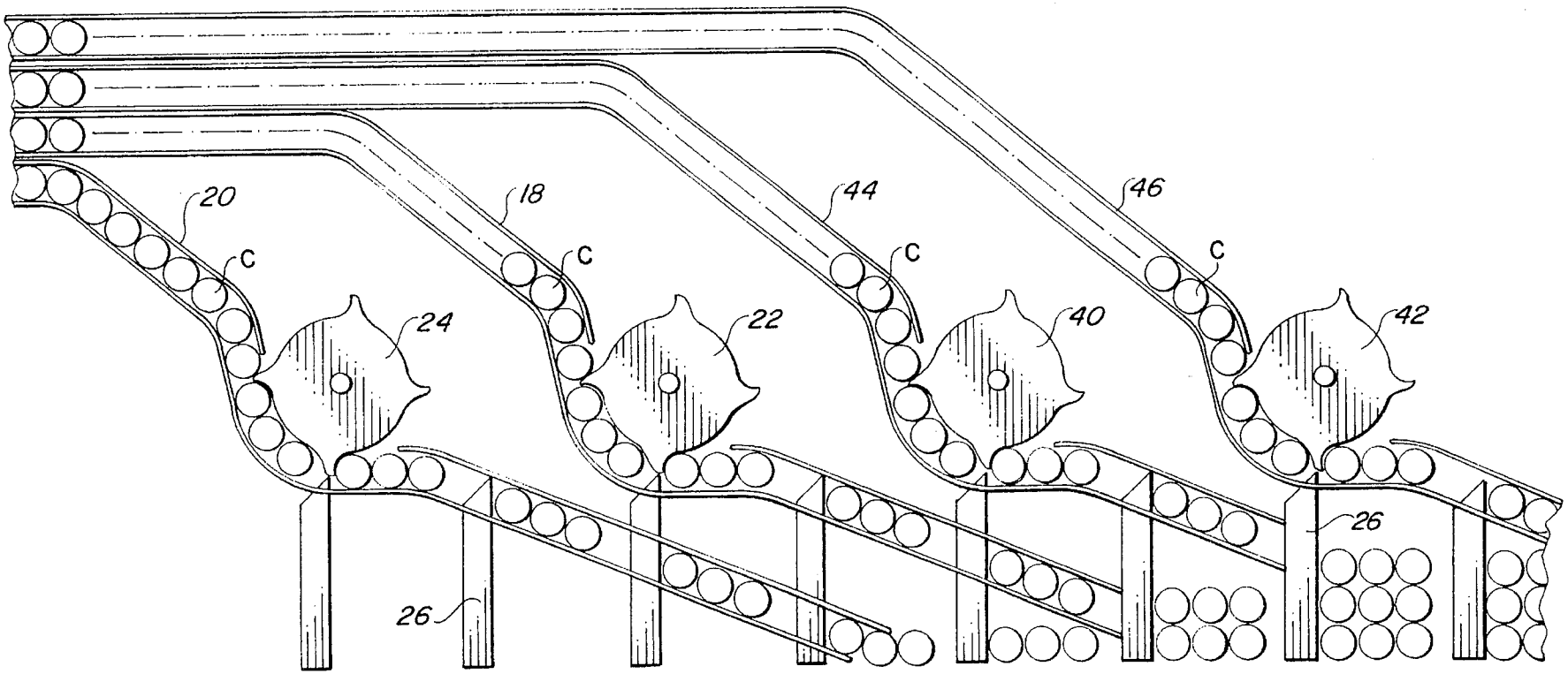
FIG. 4 is a simplified plan view of a metering section comprised of a series of four star wheels.

As best shown in FIG. 2, the star wheel 22 is rotationally out of phase with the star wheel 24 to provide for groups of three containers to be fed onto the conveyor 16 in alignment with a group of three containers previously fed onto the conveyor by the upstream star wheel 24. This is necessary due to the particular spacing of the star wheels from each other which enables the star wheel 22 to feed the second group of containers to the conveyor 16 at the next downstream pusher lug 26, and would not be required for all star wheel arrangements, as brought out further below. The inner guide rail 20 is angled to form a straight portion 38 that maintains the containers adjacent the carton sleeves S on the conveyor 16 until the containers reach the beginning of the loading area. Similarly, the inner guide rail 18 is formed into a straight portion 39 to maintain the containers remote from the sleeves in a row adjacent the first group of three containers. Although two star wheels are shown in FIGS. 1 and 2 for the purpose of providing two groups of three containers in a process that loads six containers at a time into an open end of a carton sleeve, the invention is not limited to such an arrangement. One star wheel could be provided if it is desired to load only a single group of containers at a time, as would be the case in loading a single row of containers into each open end of a carton sleeve. More than two star wheels would be provided if it is desired to load more than two groups of containers at a time. Such an arrangement is illustrated in FIG. 4, wherein two additional star wheels 40 and 42 have been added to the star wheels 22 and 24 of FIGS. 1 and 2, along with corresponding additional guide rails 44 and 46. All four star wheels are located between the infeed conveyor 14 and the accelerator conveyor 16 and are spaced from each other a distance greater than the spacing shown in FIGS. 1 and 2, whereby subsequent groups of containers are fed onto the conveyor 16 at locations corresponding to alternate downstream pusher lugs 26. With this arrangement the wheels are rotationally in phase with each other. As illustrated, four groups of three containers each are fed to the conveyor 16, which enables the pusher assembly 27 to load twelve containers through the open end of a carton sleeve. If only one side of the packaging machine is active this produces a twelve-pack carton. If both sides are active it produces a carton of twenty-four containers.

Figure 5A:
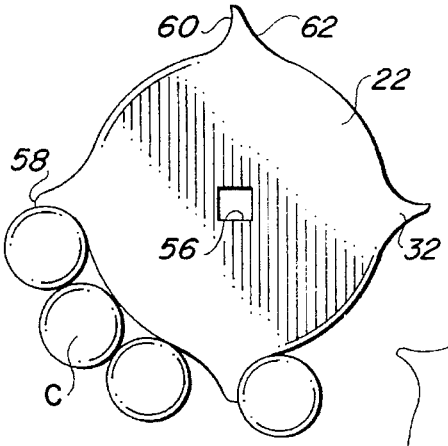
FIGS. 5A, 5B AND 5C are plan views of alternate star wheels comprised of different numbers of lugs.
Figure 5B:
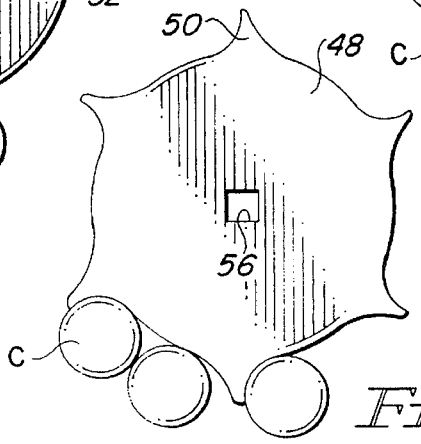
Figure 5C:
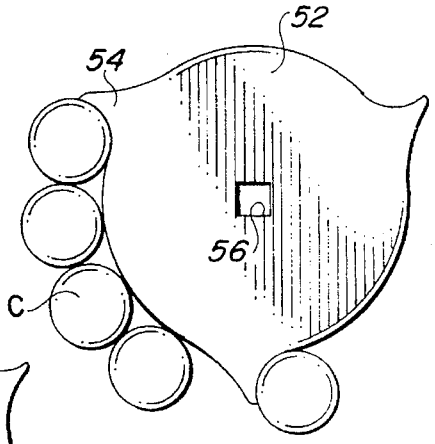

The star wheels shown thus far have four lugs and are used to segregate the flow of incoming containers to form groups of three containers each. Groups of a different number of containers may be formed by employing star wheels of different shapes. Thus, in addition to a wheel having four lugs for metering three containers to a group, wheels having three lugs for metering four containers and six lugs for metering two containers could be employed. This is illustrated in FIGS. 5A, 5B and 5C, wherein the star wheel 22 of FIG. 5A has four lugs 32 and is similar to the star wheels shown in FIGS. 1–4. The star wheel 48 of FIG. 5B has six lugs 50, and the star wheel 52 of FIG. 5C has three lugs 54. Each star wheel of these figures is of the same diameter and contains a square central opening 56 adapted to slide over the drive shaft 35, which is of the same cross-sectional shape. This enables a star wheel having a certain number of lugs to be replaced by a star wheel having a different number of lugs without danger of the replacement wheels being out of phase. In addition to the wheels being of the same diameter, the lugs of each wheel extend out a distance at least slightly beyond the centerline of a container, such as a beverage bottle or can, which is circular in cross-section at the point where it is contacted by a lug. This is illustrated by the lug tip 58 of FIG. 5A. Further, the downstream sides of the lugs, such as the surface 60 of FIG. 5A, are curved to engage the curved circumference of the containers while feeding them to the accelerator conveyor. In addition, the upstream sides of the lugs, such as the surface 62 of FIG. 5A, are shaped so as to hold back the line pressure of the incoming containers until the group currently being formed has been moved onto and is under control of the accelerator conveyor 16. In connection with this requirement, the upstream sides of the lugs can be seen to make only a slight angle with the circumference of the wheel.

Figure 6A:
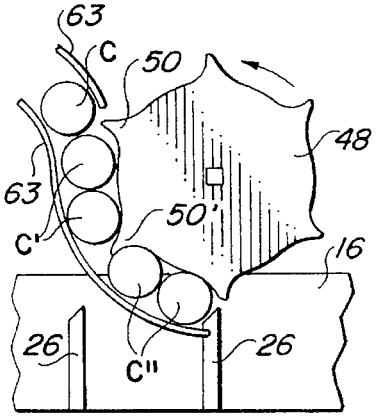
FIGS. 6A, 6B, 6C, 6D and 6E are simplified plan views sequentially showing the metering action of a star wheel formed in accordance with the invention.
Figure 6B:
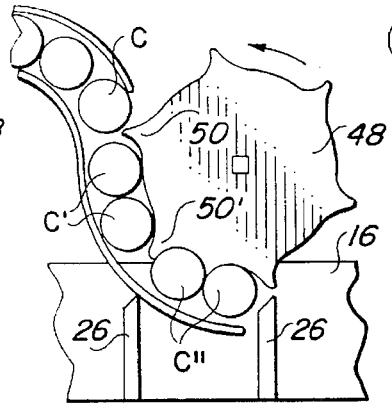
Figure 6C:
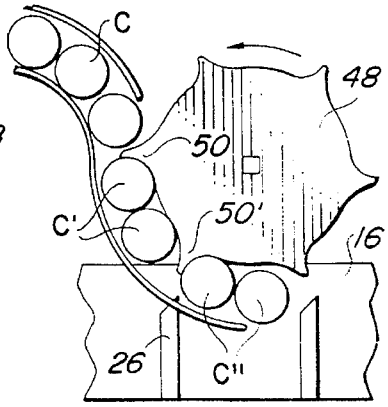

The sequence of operation of the metering wheel lugs is illustrated further in FIGS. 6A, 6B, 6C, 6D and 6E in which the star wheel 48 is shown in the process of forming a group of two containers and delivering a formed group to the conveyor 16. The lug 50 is shown in FIG. 6A to be approaching the row of containers C and C' moving toward the conveyor 16 between guide rails 63. The next downstream lug 50' at this point has already engaged a container C" and is pushing it and the next downstream container C" onto the conveyor. In FIG. 6B the wheel has rotated approximately 10° and the lug 50 has intercepted the container C. The gap between the container C and the next downstream container C' indicates that container C and the line of containers behind it have been slowed with respect to the downstream containers. The lug 50' has continued to move the upstream container C" farther onto the conveyor 16, but the greater speed of the accelerator conveyor has caused the downstream container C" to move slightly faster, creating a gap between the containers C". Continued rotation of approximately another 10° moves the star wheel into the position shown in FIG. 6C, wherein the lug 50 continues to slow the line speed of the row of containers C as the containers C' are moved toward the conveyor 16. At this point the lug 50' has lost contact with the trailing container C" in the next group as a result off the upstream container C" having also been accelerated by the conveyor 16.

Figure 6D:
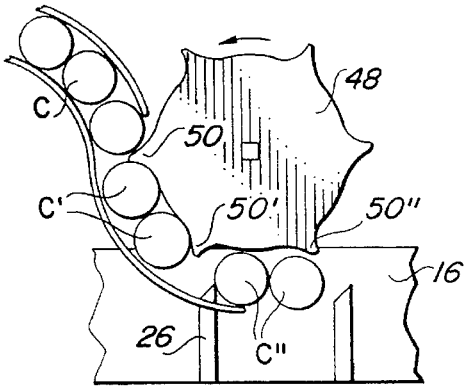
Figure 6E:
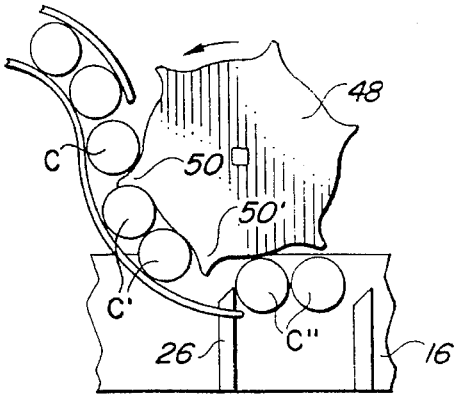

FIG. 6D represents the star wheel after another 10° rotation, and shows the containers C still being held back, the containers C" having been engaged by the conveyor lug 26 and the containers C' still moving toward the conveyor 16. Because the lug 50" prevents the conveyor 16 from moving the downstream container C" beyond it, the accelerated speed of the upstream conveyor C" closes the gap between the containers C". FIG. 6E represents the star wheel after an additional 10° rotation. At this point the lug 50 has made contact with the trailing container C' and is pushing the group of two containers C' toward the conveyor 16. The containers C" are moving rapidly away from the star wheel and the line of containers C is following the movement of lug 50. Further rotation will take the star wheel to the position shown in FIG. 6A, with the sequence of movement ready to be repeated.

Referring back to FIG. 2, it will be seen that a lug 64 is mounted on conveyor 16 adjacent to and upstream from the container engaging lug 26, and that a lug 66, carried by chain 67, is aligned with the sleeve pushing lugs 12. The lugs 64 form the downstream extremity of the so-called bucket between the lugs 26 and 64, while the lugs 66 act as a support or stop which a sleeve contacts as it is delivered to the pocket formed by the lugs 12 and 66. The lugs 26 and 64 are removably attached to the conveyor 16, while the lugs 12 and 66 are removably attached to their respective support chains. By this arrangement it is possible to rapidly modify the machine to handle different size packages.

Figure 7:
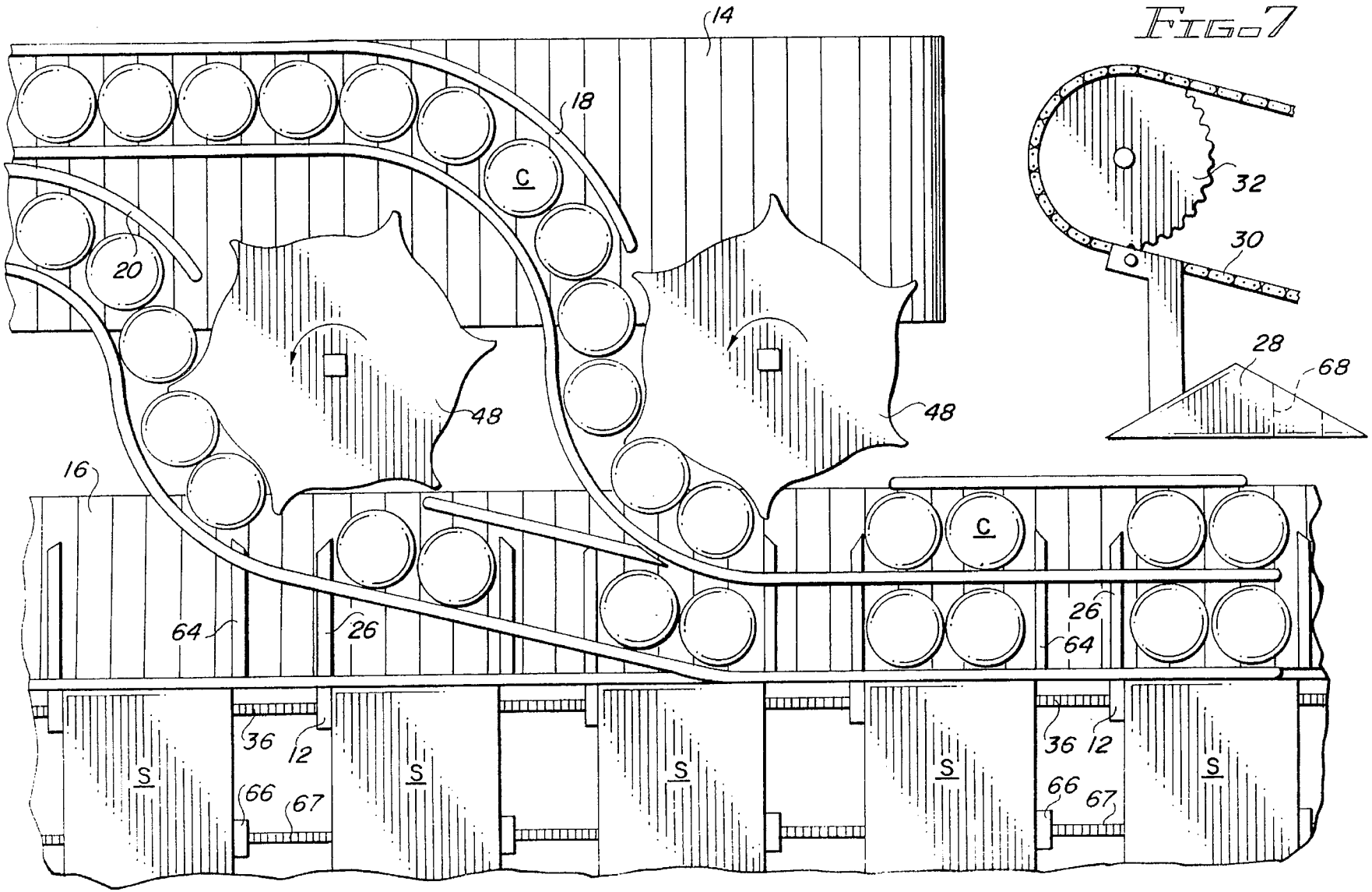
FIG. 7 is an enlarged partial plan view similar to that of FIG. 2, but showing the machine as it would function when metering and loading groups of two articles.

For example, if it is desired to package containers in smaller cartons, requiring the formation of container groups comprised of only two containers, it is merely necessary to make a few simple changes before continuing to operate. The machine is stopped and, while the lugs 26 are allowed to remain in place, the stop lugs 64 are relocated on the conveyor 16 so that the length of the bucket is shortened. In like manner, with the sleeve pushing lugs 12 remaining in place on their support chains, the lugs 66 are relocated on their support chain to shorten the length of the sleeve pocket. This results in the arrangement shown in FIG. 7, wherein a space or gap has been created between the pusher lugs 26 and the stop lugs 64 immediately upstream from the lugs 26 and between the pusher lugs 12 and the stop lugs 66 immediately upstream from the lugs 12. It is not necessary to modify the pusher assembly 17 because the pusher plates 28 include an opening 68 aligned with the new location of the stop lugs 64 which allows the plates to push the groups of two containers into the adjacent carton sleeves without being obstructed by the new location of the lugs 64. This arrangement makes it unnecessary to change the machine speed when making such a conversion.

If it is desired to change to a package requiring four containers in a group, it will be necessary to relocate all the lugs to accommodate the larger size package and to alter the spacing between pusher members 28 to align them with the wider pocket presented to the loading station. While this entails somewhat more of a task than the lug relocating described above, it is not labor intensive and it still requires only a quick change of star wheels to produce the different group size of containers.

The manner of attaching lugs to the article moving means 16 and to the sleeve moving chains has not been illustrated since any convenient mechanical means may be employed.

It can now be appreciated that the invention provides a simple, efficient way of metering the number of containers or other articles in a group to be loaded into a receptacle, and provides for rapidly changing over from one package size to another. Because the invention is not necessarily limited to all the specific details described in connection with the preferred embodiments, except as they may be required by the appended claims, changes to certain features of the preferred embodiments which do not alter the overall basic function and concept of the invention are contemplated.

What is claimed is:

1. A method of packaging articles, comprising:

moving a continuous stream of articles in a downstream direction;

moving a plurality of article receptacles in said downstream direction in a continuous path spaced from the stream of articles;

guiding a continuous row of articles from the moving stream to a driven star wheel having a plurality of outwardly extending uniformly spaced metering lugs thereon;

separating adjacent articles in the continuous row by means of the star wheel lugs to form groups of a predetermined number of articles;

guiding groups of articles pushed by the star wheels to article moving means located adjacent the row of moving receptacles, the article moving means moving in said downstream direction at the same speed as the receptacles; and replacing the star wheel with a different star wheel of substantially the same diameter but having a different number of lugs in order to form groups of a different predetermined number of articles.

2. The method of claim 1, wherein the article moving means includes spaced lugs defining the upstream and downstream boundaries of a group of articles on the article moving means, the method including the step of relocating at least some of lugs on the article moving means so as to be capable of receiving different size groups of articles.

3. The method of claim 2, wherein each group of articles is pushed in a transverse direction into an adjacent receptacle by pushing means capable of pushing article groups containing varying numbers of articles.

4. An article packaging machine, comprising:

an infeed conveyor for moving articles in a downstream direction;

means spaced from the infeed conveyor for moving article receptacles in said downstream direction;

article moving means adjacent the receptacle moving means for moving articles in said downstream direction at the same speed as the receptacle moving means, the article moving means being spaced from the infeed conveyor;

a plurality of driven star wheels spaced from each other in the downstream direction and located adjacent the same side of the article moving means between the infeed conveyor and the article moving means;

a plurality of article guide means for guiding a continuous row of moving articles from the infeed conveyor to each star wheel;

a plurality of further guide means for guiding a group of articles from each star wheel to the article moving means, the further guide means associated with a star wheel which is downstream from an upstream star wheel guiding the articles to a location on the article moving means which is downstream from the further guide means associated with said upstream star wheel;

each star wheel including a plurality of outwardly extending uniformly spaced metering lugs adapted to separate adjacent articles in the continuous row associated therewith to form groups of a predetermined number of articles and to move said groups to the article moving means at a location adjacent a receptacle on the receptacle moving means, a group moved to said location from a downstream star wheel being substantially aligned with a group moved to said location from an upstream star wheel; and means for moving the aligned groups of articles transversely from the article moving means into an adjacent receptacle.

5. A method of packaging articles, comprising:

moving a continuous stream of articles in a downstream direction;

moving a plurality of article receptacles in said downstream direction in a continuous path spaced from the stream of articles;

guiding a continuous row of articles from the moving stream to each of a plurality of driven star wheels spaced from each other in the downstream direction and located adjacent the same side of the continuous stream of moving receptacles, each star wheel having a plurality of outwardly extending uniformly spaced metering lugs thereon;

separating adjacent articles in the continuous rows by means of the metering lugs on the associated star wheel to form groups of the same number of articles;

moving said groups to an article moving means, the article moving means being adjacent the moving article receptacles and traveling in the downstream direction so that each group on the article moving means from one star wheel is substantially aligned with each group from the other star wheels and with one of the moving receptacles; and moving aligned groups of articles on the article moving means into successive moving receptacles.

6. An article packaging machine, comprising:

an infeed conveyor for moving articles in a downstream direction;

means spaced from the infeed conveyor for moving article receptacles in said downstream direction;

article moving means adjacent the receptacle moving means for moving articles in said downstream direction at the same speed as the receptacle moving means, the article moving means being spaced from the infeed conveyor;

a driven star wheel between the infeed conveyor and the article moving means; and article guide means for guiding a continuous row of moving articles from the infeed conveyor to the star wheel and from the star wheel to the article moving means;

the star wheel including a plurality of outwardly extending uniformly spaced metering lugs adapted to separate adjacent articles in the continuous row to form groups of a predetermined number of articles and to move said groups to the article moving means at a location adjacent a receptacle on the receptacle moving means;

the article moving means including spaced lugs defining the upstream and downstream boundaries of a group of articles on the article moving means, at least some of the spaced lugs being adapted to be relocated on the article moving means so as to be capable of receiving different size groups of articles, and the star wheel being adapted to be replaced with a star wheel having a greater or lesser number of lugs so as to enable the packaging machine to be modified to package groups of varying numbers of articles.

7. The article packaging machine of claim 6, including means for pushing the groups of articles in a transverse direction into an adjacent receptacle, the transverse pushing means being capable of pushing article groups containing varying numbers of articles.

* * * * *